US005489038A

United States Patent [19]

Delbrouck

[11] Patent Number: 5,489,038

[45] Date of Patent: Feb. 6, 1996

[54] BOX-SHAPED CONTAINER OF SYNTHETIC RESIN MATERIAL

[75] Inventor: Klaus Delbrouck, Köln, Germany

[73] Assignee: Franz Delbrouck GmbH, Menden, Germany

[21] Appl. No.: 249,123

[22] Filed: May 25, 1994

[30] Foreign Application Priority Data

May 25, 1993 [DE] Germany ..... 43 17 300.4

[51] Int. Cl.[6] ..... B65D 21/00

[52] U.S. Cl. ..... 220/6; 206/505; 206/515; 206/509; 229/915

[58] Field of Search ..... 206/505, 503, 206/509, 519; 220/6; 229/915

[56] References Cited

U.S. PATENT DOCUMENTS 4,247,004 1/1981 Rind ..... 206/505
4,441,615 4/1984 Goodrich ..... 206/508
4,759,451 7/1988 Apps ..... 206/505
5,305,884 4/1994 Apps ..... 206/505

FOREIGN PATENT DOCUMENTS 4126749 2/1993 Germany .

*Primary Examiner*—Joseph M. Moy
*Attorney, Agent, or Firm*—Herbert Dubno

[57] ABSTRACT

A box-like container for transporting packaged fruits and vegetables has a bottom whose central member can be pulled upwardly to cause the flaps at the bottoms of the side walls to be pulled upwardly and inwardly and the side walls to be pulled inwardly into a frustopyramital configuration enabling the box to be nested in a like box. Film hinges are provided between the side walls of a rectangular frame which itself is hollow and of rectangular cross section. Other film hinges are provided between the flaps and a central member.

20 Claims, 5 Drawing Sheets

BOX-SHAPED CONTAINER OF SYNTHETIC RESIN MATERIAL

FIELD OF THE INVENTION

The present invention relates to a box-like container of plastic, i.e. synthetic resin material, for accommodating objects, especially packages of vegetables, fruit and the like, of the type having a gripping frame surrounding the mouth of the container and for upright walls extending downwardly from this frame to a container bottom. More particularly the invention relates to a reusable plastic box for the transportation of articles and especially packaged fruits and vegetables.

BACKGROUND OF THE INVENTION

The transportation of packaged fruits and vegetables utilizes reusable containers or boxes with upwardly open mouths, side walls and a bottom, wherein the mouth can be defined by a frame forming grips for enabling the user to lift and transport the container. The container, upon emptying, can be returned to the source of the product so that it is recirculated. It is advantageous for the containers to be capable of nesting to thereby reduce the volume of the containers in the return travel, thereby minimizing the cost of returning them.

For this purpose, various container structures have been used. For example, rectangular transport containers have been provided with side walls which taper downwardly thereby enabling one container to nest in the other. However, since stacking of the containers when they contain goods to be transported is a necessity and nesting will cause the weight of upper containers to be applied to goods in lower containers, metal stirrups or bails have been provided on these tapered-wall containers to support the frames of each upper container upon the frame of a lower container and thereby prevent the nesting. These metal stirrups were swingable from the plane of the mouth of the respective container downwardly into vertical orientations in which they could support the respective container on a lower container.

This construction was difficult to handle and relatively costly because of the need for separate fabrication and assembly of the wire stirrups.

The art is also aware of containers in which the container walls themselves can be swung from folded positions into erect positions and vice versa. In the folded or collapsed position of the walls, the containers have a minimal volume and are thus capable of being transported at low cost. When the walls are unfolded, however, to erect the container, one container can be supported on the rim or frame of the next in stacking of the containers. These systems have the drawback that erection of the container is time-consuming and generally requires a number of manipulative steps which may be difficult to carry out.

DE 41 26 749 A1 describes a plastic container having two opposite side walls rigid with a frame and a bottom while two other side walls can be folded inwardly. When these side walls have been folded in, the containers can be nested in one another for transport. When the side walls are folded out, however, they provide force-transmitting walls which enable one container to be stacked upon another. These containers also have been found to be expensive to fabricate and time-consuming and complex to set up and fold up.

OBJECTS OF THE INVENTION

It is, therefore, the principal object of the present invention to provide a box-like container for the purposes described, i.e. for the reusable transport of packaged fruits and vegetables and like objects, which can be fabricated simply and inexpensively, can be switched over from a stacking state to a nesting state with relatively simple and rapid operations and which, therefore, can be returned to the user in a nested and hence low-volume condition at relatively low transport cost.

Another object of the invention is to overcome the drawbacks of earlier boxes or box-like containers as described and hence provide an improved box for such transport which is free from those drawbacks.

SUMMARY OF THE INVENTION

These objects and others which will become apparent hereinafter are attained, in accordance with the invention by hinging the side walls at their upper edges to the grip frame and providing the lower edges of the side walls with a flat region or tongue which forms a part of the bottom, the remainder of the bottom being constituted by a rectangular central member to which the flat flaps or tongues are articulated at their edges opposite the sides of the flaps or tongues turned toward the respective side of the box.

The articulated connection of the side walls with the bottom is so effected that when the flat portions or tongues, i.e. the flaps, and the central portion are coplanar, the side walls are substantially vertical and the box can be stacked on another box located therebelow. Conversely, when the rectangular central member is drawn upwardly toward the mouth-forming frame of the box, all four side walls are swung inwardly to enable an upper box to be nested in a lower box for transportation of the nested boxes.

More specifically, the box for the transportation of such objects as packages of fruits and vegetables, can comprise:

- a substantially rectangular plastic gripping frame defining a mouth of the box and having four limbs;
- four plastic side walls pivotally connected to respective ones of the limbs at upper edges of the side walls and extending downwardly from the limbs;
- respective flat flaps connected to the side walls and extending inwardly therefrom and forming parts of a bottom of the box; and
- a planar central bottom-forming member hinged to inner edges of the flaps and substantially coplanar with the flaps in a stacking position wherein the side walls are substantially vertical and a plurality of the boxes can be stacked with their respective side walls in mutual alignment, the central bottom-forming member being displaceable upwardly toward the frame to draw the side walls inwardly and permit one of the boxes to nest within another of the boxes.

Preferably the side walls and the extensions thereof or tongues, referred to generically herein as flaps, which form portions of the bottom, are of L-shape, whereby the upper edge of the side wall is hinged to the respective limb of the frame and the free end forms an inner edge of the flap which is hinged to the rectangular central member described previously.

When the central member is then pulled up toward the frame or mouth from the inside of the box or pressed upwardly from the outside toward the mouth, the flaps are swung upwardly and inwardly and the side walls are swung inwardly to impart a downwardly tapered configuration to the side walls and enable the nesting of a box in a lower container.

To restore the box to its stacking position, it is merely necessary to press the bottom forming the central member downwardly manually or upon filling the box with the articles and lifting the frame upwardly, to thereby swing the flaps downwardly and outwardly toward side walls outwardly into a vertical orientation to transform the container into a rectangular parallelepided and thereby restore the right angles between the bottoms and the side walls and between the side walls themselves. In this position, the boxes can be readily stacked with their respective bottoms on the frames of lower boxes without damage to the contents. It will be apparent, therefore, that the invention enables not only the simple fabrication of the container but facile manipulation thereof.

The various hinges and articulations described are preferably film hinges according to the invention. These hinges can be fabricated during the injection-molding process which can form the frame, side wall, flaps and central bottom member in one piece. Separate mounting and fabrication steps for a number of parts can thereby be avoided.

To provide the requisite clearance for the inward swinging of the side walls and flaps into the stacking positions, the side walls and the flaps are preferably formed with trapezoidal configurations with the large base of the side walls being constituted by the upper edges hinged to the respective frame limbs and the small bases of the flaps being hinged to the central bottom forming member.

Trapezoidal configurations of the side walls enable them to be folded inwardly until their lateral edges engage one another in a frustopyramid configuration of the box for nesting. When the side walls are swung outwardly, gaps are formed between the lateral edges which can provide openings for ventilating the contents of the box if desired.

If such openings are not-desirable, I can close these openings with a flexible film or other thin material bridging the side walls and, of course, contracting or folding when the side walls are drawn toward one another laterally in the transformation of the box into its nesting position.

The films or bridges of thin material thus do not impede the inward and outward swinging of the side walls but in the outwardly swung positions close the gaps between the side walls. If desired, however, the bridging film can prevent swinging outwardly of the side walls past their vertical positions. Alternatively, the frame can be formed with ribs which form stops for the outward swinging of the side walls according to a feature of the invention.

It has been found to be advantageous to provide bars at the articulations between the flaps and the central member to limit the outward swing or displacement at these articulations. Thus, once the flaps and central bottom-forming member have been brought into coplanarity in the stacking position of the box, further outward displacement is prevented by these bars.

To facilitate the lifting of the central bottom-forming member into the nesting position, it has been found to be advantageous to provide the central member with a pair of throughgoing slots which define a grip bar or web between them, preferably centrally of the central member.

To ensure reliable stacking of the open boxes upon one another, the frames may be formed along their upwardly-turned faces with openings or recesses while the bottoms of each box can have projections aligned with these recesses so that in the stacking position, a projection on the bottom of an upper box can fit into the respective recess on the frame of a lower box. These projections can be on the flaps proximal to the junctions of the flaps with the respective side walls.

It has been found to be advantageous, moreover, to set the outer surfaces of the side walls inwardly from the outer surfaces of the frame in forming side walls on the respective frame limbs and to form outer surfaces of the side walls with vertical ribs which begin at the underside of the frame and thus abut thereagainst when the side walls are swung outwardly into their limiting vertical positions. These ribs thus also can serve to limit the outward swinging movement of the side walls. The ribs advantageously extend over half the height of the side walls and in cross section can be channel-shaped or of V section, being open outwardly. Upon nesting of the channels, these ribs can serve as guides which facilitate fitting one container into the other.

To minimize weight and provide substantial torsional stability, the gripping frame can be a closed hollow profile, especially of rectangular cross section and it is preferred, moreover, that two opposite parallel limbs of the frame be provided centrally with gripping cutouts.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
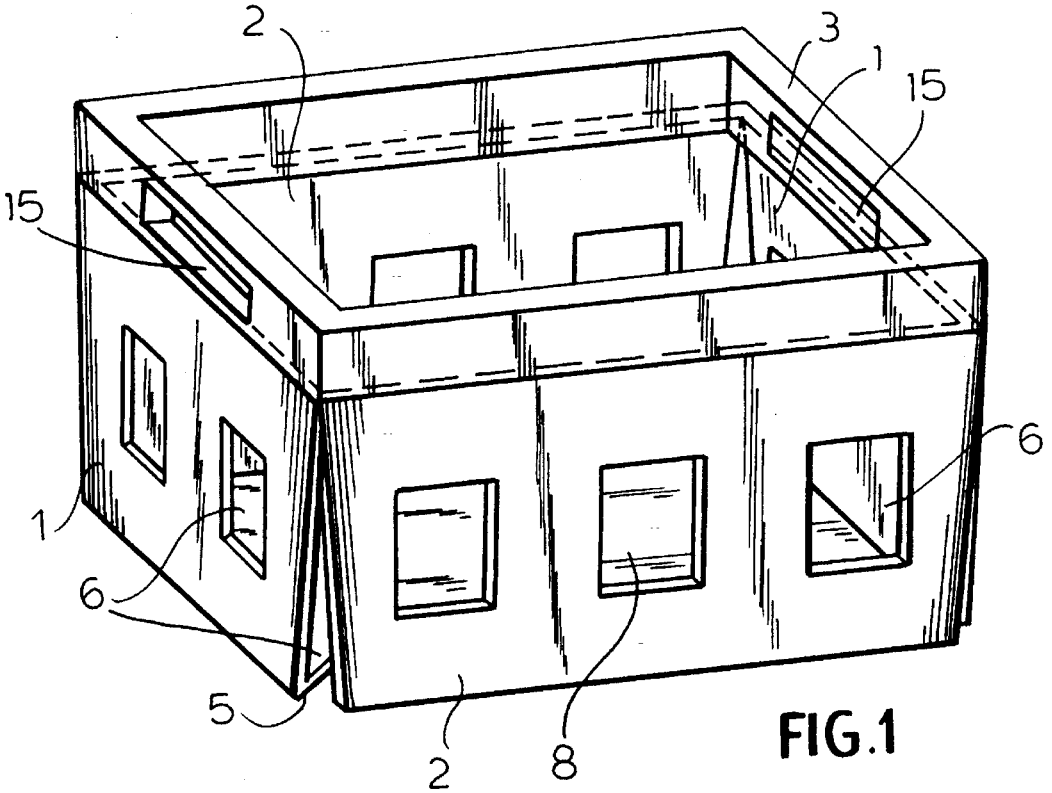
FIG. 1 is a highly diagrammatic perspective view showing a transport box according to the invention in its open position for stacking and adapted to receive the articles to be transported.
Figure 2:
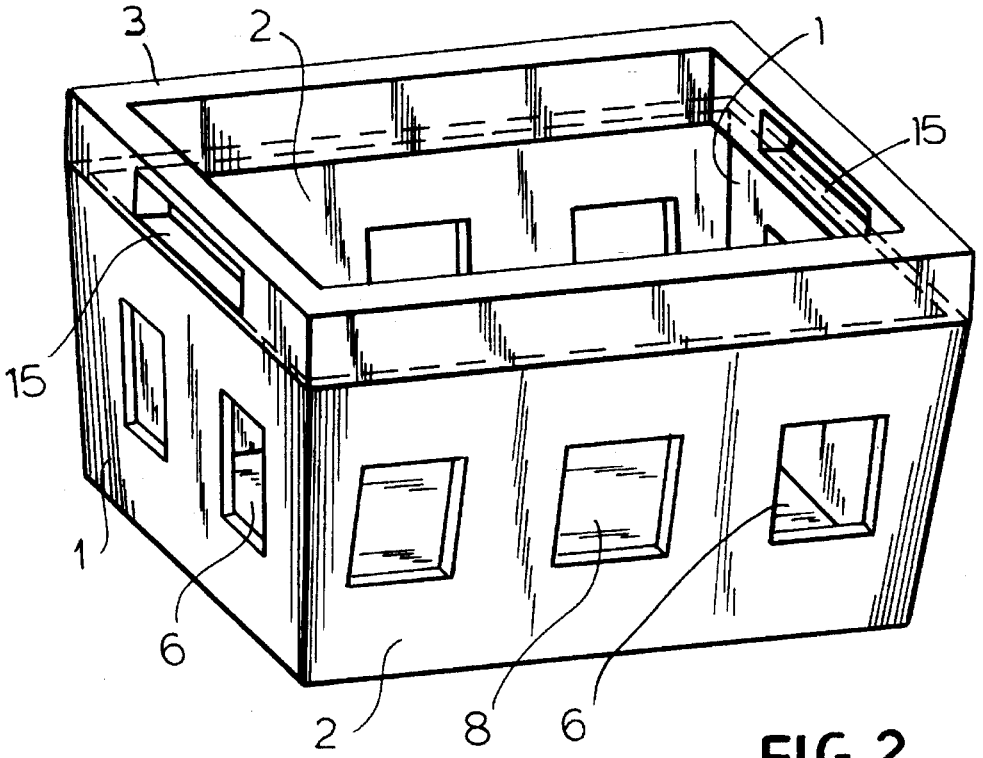
FIG. 2 is a view similar to FIG. 1 showing the side walls of the box drawn inwardly for nesting.
Figure 3:
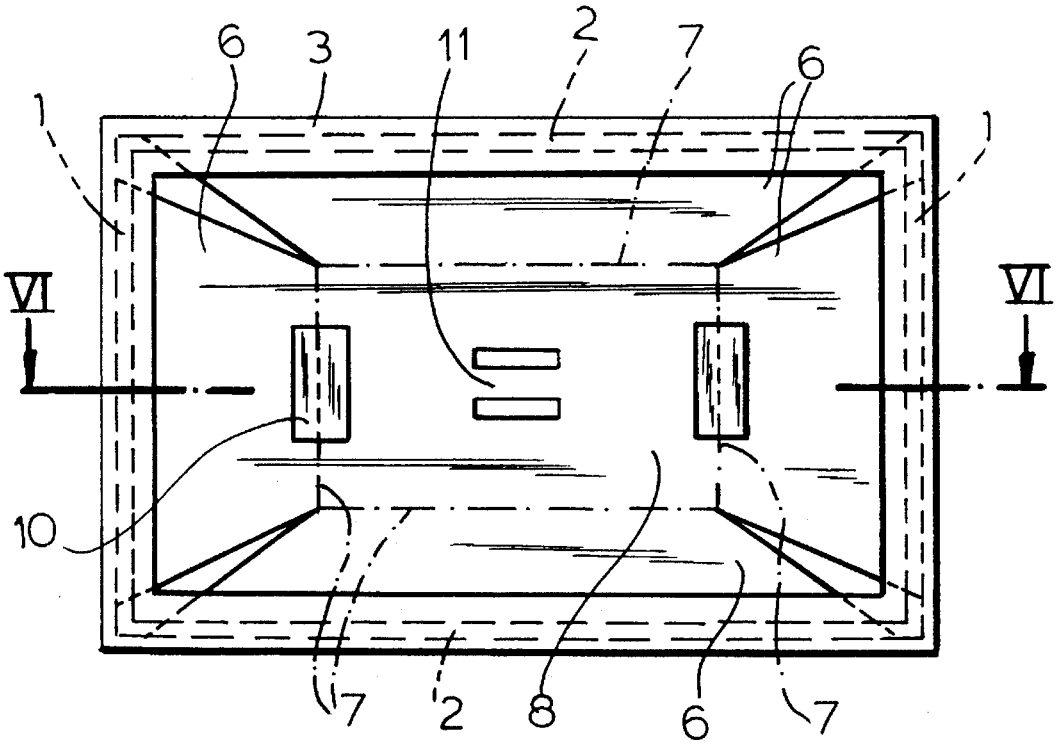
FIG. 3 is a plan view of the box in the position shown in FIG. 1.

The drawing shows the box-like container of plastic, in accordance with the invention, for transporting any kind of article, especially packaged vegetables and fruits. The container comprises a bottom, four side walls 1, 2 extending upwardly from the bottom and a peripheral frame 3 which can be gripped by the user for lifting the box, stacking one box upon another box, or nesting one box in another box as will be described in greater detail hereinafter.

Figure 12:
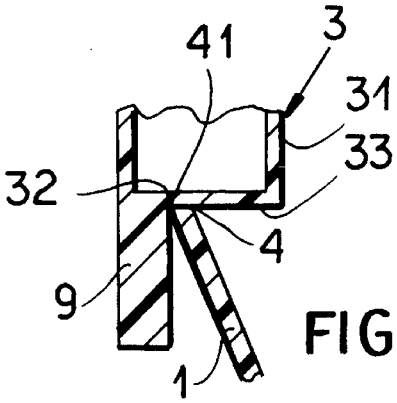
FIG. 12 is a detail view showing the hinge connection between a side wall and the frame according to the invention.

The side walls 1 and 2 have their upper edges 4 hinged to respective limbs of the rectangular grip frame. Referring to FIG. 12, for example, where the wall 1 is shown to be connected at its upper edge 4 to the limb 31 of the frame 3 at the junction 32 between a ledge or stop 9 and the underside 33 of the limb, it can be seen that a film hinge 41 which is injection molded unitarily with the wall 1 and the frame 3 can be formed to provide the articulation.

The lower edge 5 of the side walls 1 and 2 angularly adjoin a flat extension 6 referred to here as a flap and which can be in the form of one or more tongues, extending inwardly to form a part of the bottom. At the edge 5 between the side wall 1 or 2 and the respective flap 6, an articulation can be formed which allows swinging movement of the flap 6 in the direction of the arrow 61 visible in FIG. 6. The flap 6 is provided at its innermost edge 7 with a film-hinge joint with a rectangular central bottom-forming member 8. The member 8 and the flaps 6 can lie in a common plane (see FIGS. 1 and 6) in which case the walls 1 and 2 are vertical. As a comparison of FIGS. 6 and 7 will show, however, when the central member 8 is drawn upwardly toward the frame 3, the flaps 6 bend upwardly and inwardly about their articulations with the side walls 1 and 2 and the side walls 1 and 2 are drawn inwardly (FIGS. 1 and 7) so that the side walls can fit within the frame 3 and the boxes can be nested in their frustopyramital configurations to occupy reduced space for shipment of the boxes back to the packer. In the position shown in FIGS. 1 and 6, of course, the boxes can be stacked on one another without extending one into the other which might damage any goods contained in the boxes.

The side walls 1, 2 and the flaps thus are of trapezoidal configuration with the long base of the side walls 1 and 2 being hinged at 4 to the frame 3 and the short base of the flap being hinged at 7 to the bottom-forming part 8.

Figure 10:
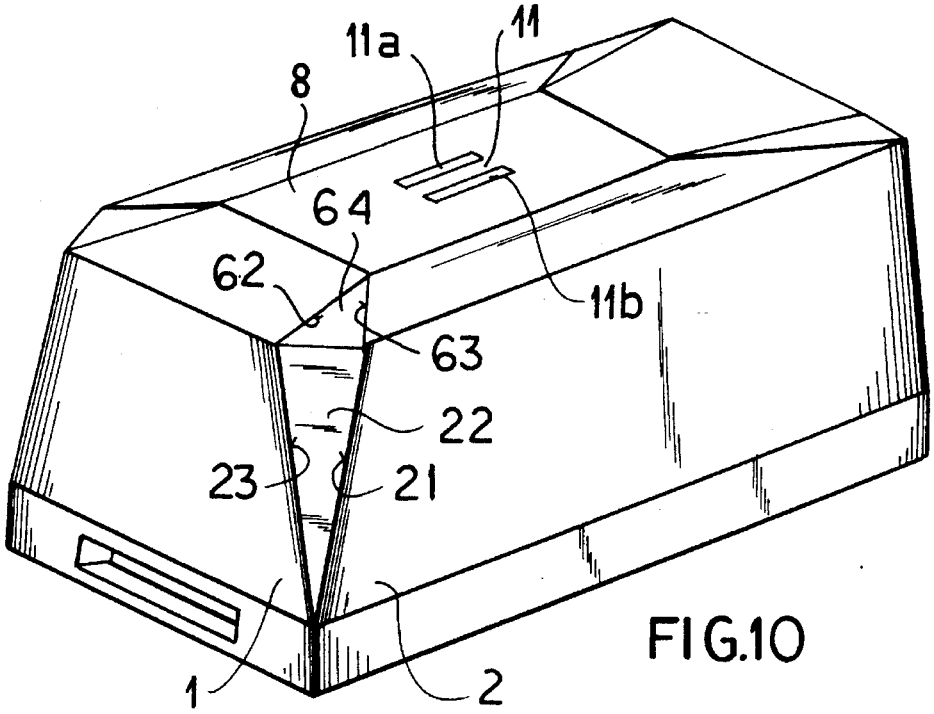
FIG. 10 is a bottom perspective view showing still another embodiment of a box according to the invention, open into the position in which the side walls are vertical.

As can be seen from FIG. 10, the gaps between the lateral edges 23 and 21 of the side walls 1 and 2 and the gap between the lateral edges 62 and 63 of adjoining flaps can be filled with a thin bridge of material such as the web 64 or the web 22. This material can be flexible and/or stretchable.

Figure 6:
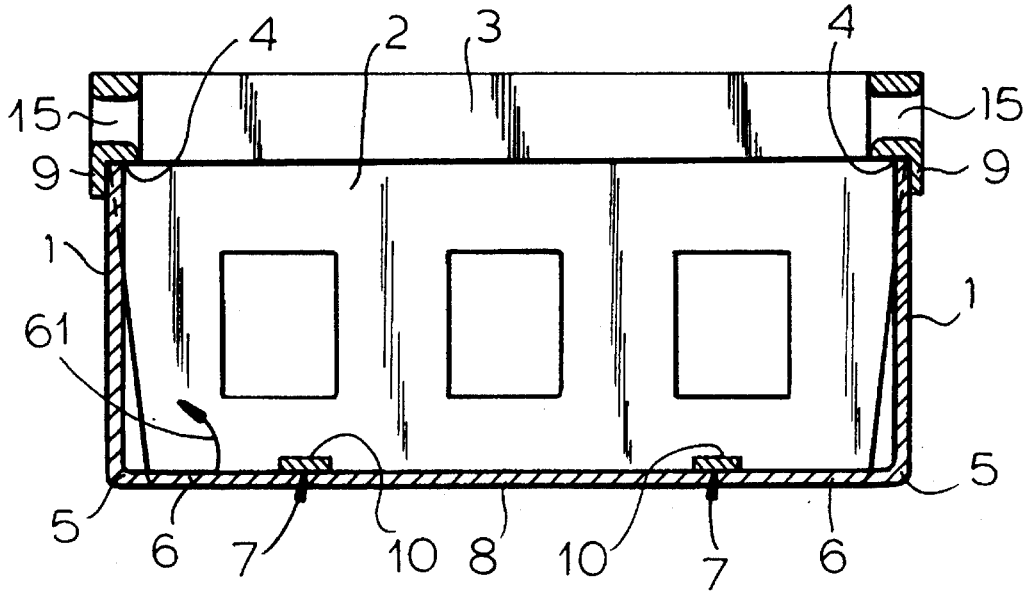
FIG. 6 cross sectional view taken along the line VI—VI of FIG. 3.
Figure 4:
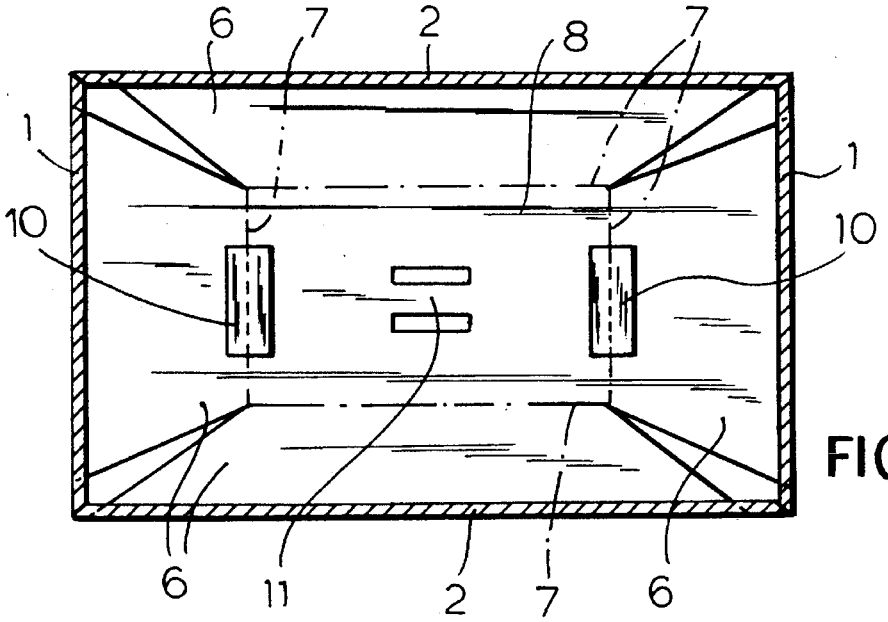
FIG. 4 is a view of the box from above, also in the open position and with the gripping frame cut away.
Figure 7:
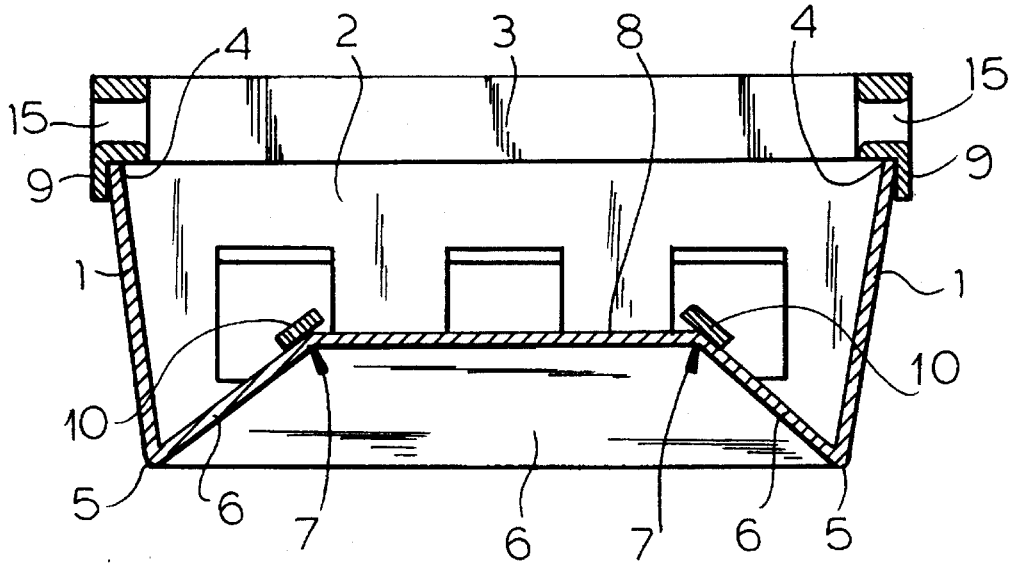
FIG. 7 is a cross sectional view taken along the line VII—VII of FIG. 5.

The frame 3 has the aforementioned abutment ledge 9 limiting the outward swing of the wide walls i and 2 (see FIGS. 1 and 6). On the lower edges of the flap 6 and/or the central member 8 adjacent these edges, abutment bars 10 are provided which, in the positions shown in FIGS. 1 and 6, prevent excessive outward displacement of the bottom.

Figure 8:
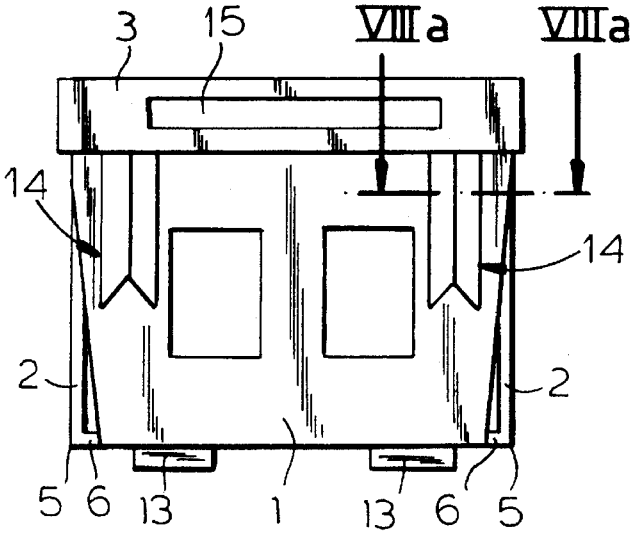
FIG. 8 is an end view of a box according to a variant, shown with the side walls in their vertical outer positions.

To facilitate servicing of the container, i.e. the drawing of the plate 8 upwardly, this plate or central member is provided with a gripping bar 11 between a pair of slots **11*a* and 11*b*, centrally of the member 8 so that the user can readily pull the central member from the position shown in FIG. 6 to the position shown in FIG. 8**.

Figure 9:
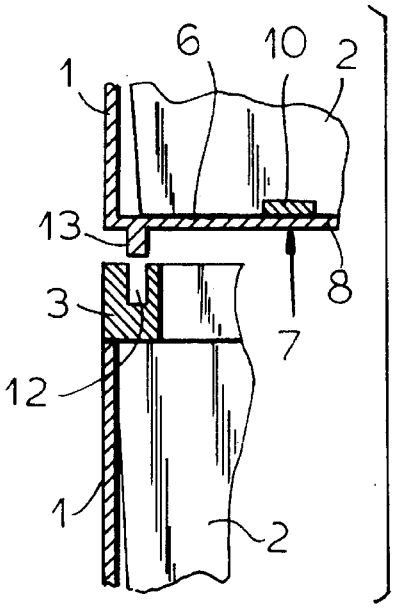
FIG. 9 is a cross sectional view showing the stacking of two boxes of the type shown in FIG. 8.
Figure 8A:
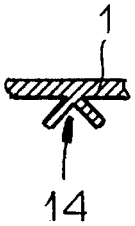
FIG. 8*a* is a cross sectional view taken along the line VIIIa—VIIIa of FIG. 8.
Figure 5:
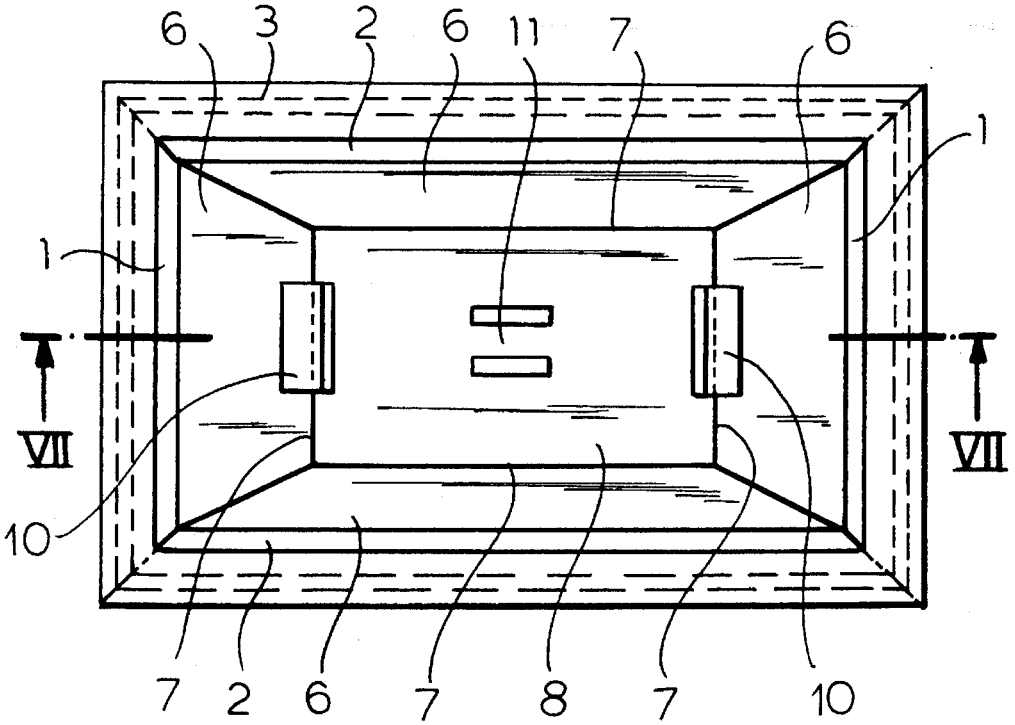
FIG. 5 is view similar to FIG. 13 showing the box with the side walls drawn inwardly.

As is especially apparent from FIG. 9, the frame 3 can be provided at its end face with recesses 12 in which projections 13 on the bottom of an upper box can be inserted for stacking of the boxes in a secure and reliable manner. The projections 13 are formed with flaps 6 adjacent the side walls 1 and 2.

The side walls are so mounted on the frame 3 that their outer surfaces are offset inwardly from the outer surfaces of the gripping frame 3 as is especially apparent from FIG. 8.

On the outer surfaces of these side walls, especially the side walls 1, ribs 14 are formed which can abut on the underside 33 of the frame and extend downwardly therefrom over half the height of the side walls 1 and 2.

These ribs 14 brace against the frame 3 and prevent excessive outward movement of the side walls. The side walls are hollow and channel shaped, being open outwardly and can have V-shaped cross sections as is especially apparent from FIGS. 8 and **8*a*. The opening of the channel, of course, is turned away from the respective side wall 1**. These channels form guides facilitating insertion of one frustoconical box into another for nesting. Channels ensure relatively large depth of nesting for the nested receptacles.

The frame 3 is preferably formed as a closed hollow profile of rectangular cross section and can be formed centrally of the two shorter limbs of the frame with cutouts or recesses 15 which enable the frame to be gripped by the hands of the users.

Figure 13:
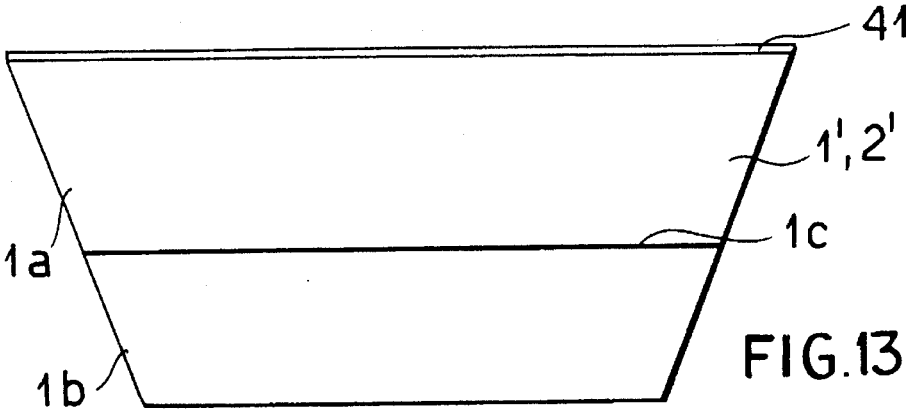
FIG. 13 is an elevational view of another side wall in accordance with the principle of this invention.
Figure 11:
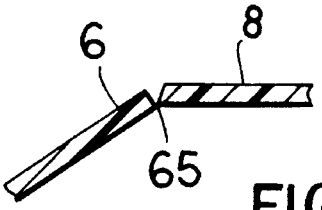
FIG. 11 is a detail cross sectional view illustrating the film hinges between the central member and the flaps according to the invention.

As can be seen from FIG. 13, the walls, e.g. the walls 1' or 2', may be formed from a plurality of segments **1*a*, 1*b* interconnected by a film hinge 1*c* formed with an articulation between the segments 1*a* and 1*b* parallel to the film hinges 41 and 65 between the side walls 1, 2 and the frame 3 and between the flaps 6 and the central member 8 (FIG. 11**), respectively.

I claim:

1. A reusable box, especially for the transportation of objects such as packages of fruit and vegetables, said box comprising:

a substantially rectangular plastic gripping frame defining a mouth of the box and having four limbs;

four plastic side walls pivotally connected to respective ones of said limbs at upper edges of said side walls and extending downwardly from said limbs;

respective flat flaps connected to said side walls and extending inwardly therefrom and forming parts of a bottom of said box; and a planar central bottom-forming member hinged to inner edges of said flaps and substantially coplanar with said flaps in a stacking position wherein said side walls are substantially vertical and a plurality of the boxes can be stacked with their respective side walls in mutual alignment, said central bottom-forming member being displaceable upwardly toward said frame to draw said side walls inwardly and permit one of said boxes to nest within another of said boxes.

2. The box defined in claim 1 wherein said flaps are connected to said central member and said side walls are connected to said limbs of said frame by film hinges.

3. The box defined in claim 1 wherein said sidewalls and said flaps are generally of trapezoidal shape, a long base of each side being hinged to the respective limb and a short base of each flap being hinged to a respective edge of said central member.

4. The box defined in claim 1 wherein juxtaposed edges of said side walls are interconnected by thin flexible film bridges.

5. The box defined in claim 1 wherein each of said limbs of said frame is formed with an abutment bar forming a stop limiting outward swinging of a respective side wall for holding said side wall in a substantially vertical orientation for stacking of said boxes.

6. The box defined in claim 1 wherein abutment bars are provided at hinges between said central member and said flaps for limiting outward displacement of the bottom of the box into said position for stacking of said boxes.

7. The box defined in claim 1 wherein said central member is formed centrally thereof with two generally parallel cutouts defining a gripping bar between them.

8. The box defined in claim 1 wherein said frame is formed at an upper side thereof with openings and projections are formed on a bottom of the container in alignment with said openings whereby the projections of an upper box fit into the openings of a lower box upon stacking of one box onto another box.

9. The box defined in claim 1 wherein each of said side walls is offset inwardly from an outer surface of said frame and the outer surfaces of said side walls are formed with downwardly extending ribs beginning adjacent an underside of the respective limb.

10. The box defined in claim 9 wherein said ribs extend over substantially half the height of said side walls.

11. The box defined in claim 10 wherein said ribs are of channel configuration.

12. The box defined in claim 11 wherein said ribs are of V-cross section opening away from the respective side wall.

13. The box defined in claim 1 wherein said frame is a circumferentially closed hollow profile.

14. The box defined in claim 13 wherein said hollow profile has a rectangular cross section.

15. The box defined in claim 1 wherein two opposite ones of said limbs are formed centrally with respective grip cutouts enabling handling of the box.

16. The box defined in claim 1 wherein the side walls are formed from segments hingedly interconnected along pivot axes parallel to upper and lower edges of the side walls.

17. The box defined in claim 1 wherein the side walls are hingedly interconnected with the respective flaps at lower edges of said side walls along pivot axes parallel to the lower edges of said side walls.

18. The box defined in claim 1 wherein said side walls are hingedly interconnected with the central member at lower edges of the side walls along pivot axes parallel to the lower edges.

19. A reusable box, especially for the transportation of objects such as packages of fruit and vegetables, said box comprising:

a substantially rectangular plastic gripping frame defining a mouth of the box and having four limbs;

four plastic side walls pivotally connected to respective ones of said limbs at upper edges of said side walls and extending downwardly from said limbs;

respective flat flaps articulated to said side walls and extending inwardly therefrom and forming parts of a bottom of said box; and a planar central bottom-forming member hinged to inner edges of said flaps and substantially coplanar with said flaps in a stacking position wherein said side walls are substantially vertical and a plurality of the boxes can be stacked with their respective side walls in mutual alignment, said central bottom-forming member being displaceable upwardly toward said frame to draw said side walls inwardly and permit one of said boxes to nest within another of said boxes.

20. The box defined in claim 1 wherein said sidewalls and said flaps are generally of trapezoidal shape, a long base of each side being hinged to the respective limb and a short base of each flap being hinged to a respective edge of said central member.

* * * * *